United States Patent [19]

Payton

[11] 3,955,307

[45] May 11, 1976

[54] DOLL HOUSE

[76] Inventor: Jo Ann L. Payton, 416 Jupiter St., Washington Court House, Ohio 43160

[22] Filed: Jan. 30, 1974

[21] Appl. No.: 437,869

[52] U.S. Cl. ..... 46/12; 35/16
[51] Int. Cl.² ..... A63H 33/00
[58] Field of Search ..... 46/1 R, 12, 236, 16, 46/17, 19; 35/7 A, 16; 273/1 M

[56] References Cited

UNITED STATES PATENTS

| | | | |
|---|---|---|---|
| 2,528,211 | 10/1950 | Civkin et al. | 35/16 |
| 3,640,537 | 2/1972 | Kramer et al. | 273/161 |

FOREIGN PATENTS OR APPLICATIONS

| | | | |
|---|---|---|---|
| 1,354,701 | 1/1964 | France | 35/16 |
| 979,358 | 1/1965 | United Kingdom | 35/7 A |

*Primary Examiner*—Louis G. Mancene
*Assistant Examiner*—Jack Q. Lever
*Attorney, Agent, or Firm*—Biebel, French & Nauman

[57] ABSTRACT

Disclosed is an improved doll house, and in particular a hanging doll house, which is essentially two-dimensional, but which gives a child the impression that the doll house is three-dimensional. Generally the doll house comprises an essentially planar, magnetically responsive center member or panel having peripheral edges which define an outline of a building interior and being surface-printed to three-dimensionally illustrate a plurality of interior rooms in the building, a plurality of essentially planar, magnetically responsive pieces, surface-printed so as to illustrate threedimensionally pieces of furniture, furnishings, fittings and the like and which are attached magnetically to the surface of the center member to illustrate completed interior rooms, and means for supporting said member in contact with a wall in hanging and supporting relationship. Side members may additionally be hingedly attached to the center member, which are swingable in front of the center panel to close it, and away from and along side of the center panel to open it. The side members may be surface-printed, also, to illustrate other scenes three-dimensionally, such as the exterior or front of the building and the like.

6 Claims, 7 Drawing Figures

DOLL HOUSE

BACKGROUND OF THE INVENTION

This invention relates to doll houses, and in particular to a hanging doll house, which is essentially two-dimensional, while possessing three-dimensional characteristics.

Doll houses are traditionally three-dimensional because three-dimensionality allows children to play in a scaled down version of a house, which possesses a certain amount of realism. As with the doll houses, the pieces of furniture and the like are also scaled down, while possessing essentially all of the details of full size pieces of furniture, fittings, and the like.

The traditional three-dimensional doll house generally proves to be frustrating, useless and unsafe when the child is either too young, i.e., little children, toddlers and the like, or when the child is handicapped in some way, either mentally or physically. The traditional doll houses are often frustrating to the point of their being of reduced usefulness because generally the small size and fragility of the pieces makes manipulating the pieces difficult. Further, children in the above catagories often have not entirely mastered three-dimensional relationships, and so the placing of the pieces can become both a difficult and frustrating experience.

A need therefore exists for a doll house which possesses some three-dimensional characteristics, while being manipulatable by children unable to play with three-dimensional doll houses.

SUMMARY OF THE INVENTION

This invention is directed to an essentially two-dimensional doll house having characteristics of three-dimensionality. In the preferred embodiment, the novel doll house comprises an essentially planar, magnetically responsive center member or panel, which three-dimensionally illustrates a house interior and which attracts and holds magnetic pieces, side members or panels on either side of the center member and hingedly connected thereto along the vertical peripheral edges thereof, and essentially planar, magnetically responsive pieces, which are printed to three-dimensionally illustrate pieces of furniture, furnishings and the like.

The term magnetically responsive is intended to include both materials which attract and/or are attracted to magnets and magnets themselves. The term doll house is not limited to a building which is a house, and so is inclusive of hospitals, factories, supermarkets, and the like buildings, as long as they are toys resembling buildngs, i.e., doll houses, for children to play with. Further, the reference throughout this application to a house interior, exterior, and the like is not an intention to limit the invention to a house, and so the reference is only intended to be exemplary of a building structure.

The side panels are swingable about the hinges to pivot and move the side panels from a closed position in which the center member is covered to an open position in which the center member is exposed. Thus, the closed doll house is two thicknesses, while the open doll house is one thickness.

The doll house of the invention may be hung in a vertical position, such as on a wall or the like. Thus a child could stand or sit to play with it, and it would be within easy reach of the child, even, for example, a child in a wheel chair. The essentially planar pieces, printed to three-dimensionally illustrate furniture and the like are magnetically adhered to the panels, so that the pieces of furniture or whatever may be arranged at will in the rooms of the doll house. When the child is through playing, the side members need only be swung shut to close the doll house and cover the house interior.

The center member comprises essentially two major surfaces: an outer exposed surface and an inner supportive surface. The exterior or peripheral edge of the center member describes the outline of a house interior. The outward facing surface is magnetically responsive and is printed so as to give the impression, or be suggestive of the interior of a house, i.e., the printing is such that there appears to be three-dimensional rooms in the interior. The printing need not be an exact reproduction of the interior of a room. It need only give the child the impression, i.e., be suggestive of, the interior rooms of a house.

The side members are also essentially planar, and comprise essentially two major faces. The faces exposed in the closed position, i.e., when the side members cover the center member, may be printed to illustrate the exterior of the house, while the interior faces, i.e., those exposed in the open position, may be printed to illustrate exterior scenes, such as the environment which surrounds the house. The side members may also be magnetically responsive.

The doll house need not include the side members, and thus could comprise only the center member, and the magnetic pieces. Alternatively, a single side member or even three or more, could be used instead of the two employed in the preferred embodiment.

Thus, the novel doll house of the invention allows a child, who is unable to handle three-dimensional relationships and pieces, to play with an essentially two dimensional doll house which gives the child the impression that the doll house is three-dimensional.

It is therefore an object of this invention to provide an improved doll house for children who are unable to play with three-dimensional doll houses, and yet gives the children the impression that it is three dimensional.

Other objects and advantages of the invention will be apparent from the following description, the accompanying drawings and the appended claims.

BRIEF DESCRIPTION OF THE DRAWINGS

In the drawings

FIG. 5 is a front elevation similar to FIG. 3, showing the use of the doll house and the placement of pieces of furniture and the like.

DESCRIPTION OF THE PREFERRED EMBODIMENT

Figure 1:
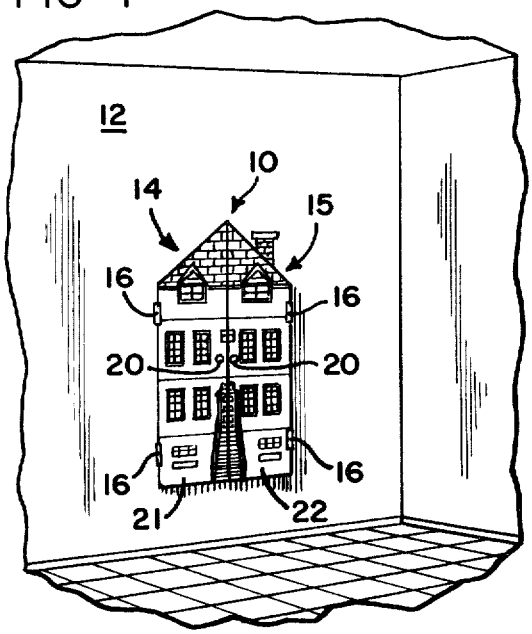
FIG. 1 is a perspective view of a preferred embodiment of closed, hanging doll house in accordance with the teachings of the invention.
Figure 2:
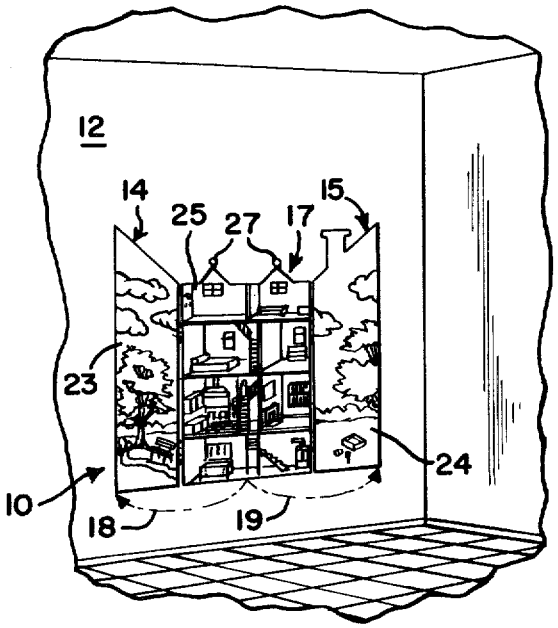
FIG. 2 is a perspective view, similar to FIG. 1 wherein the doll house is open.

In the drawings, and particularly FIGS. 1 and 2, the improved doll house 10 of the invention is shown hanging on wall 12. Doll house 10 generally comprises side members or panels 14 and 15 connected by hinges 16 on either side of a center member or panel 17. Side panels 14 and 15 rotate or pivot about hinges 16 into open and closed relationships or positions.

In the closed position (FIG. 1), the exterior peripheral edges of combined panels 14 and 15, i.e., the top, bottom and hingedly connect edges, described the outline of the building exterior, which in this case is a house. When panels 14 and 15 are rotated about hinges 16, as shown by arrows 18 and 19, by pulling on knobs 20, doll house 10 is opened.

Panels 14, 15 and 17 are each comprised of essentially two major surfaces. The panels are of a material which attracts and hold magnetic pieces, or of some substrate material, such as wood, plastic or the like, coated with or having adhere thereto a magnetic material. Thus, the magnetically responsive panels include those which are magnetically responsive throughout, e.g., steel panels, as well as those with a magnetically responsive surface, e.g., having a coating of magnetically responsive material. The thickness of the panels is not critical, and need only be enough so that panels 14, 15, 16 and 17 will be rigid enough to be played with, without excessive flexing. The overall dimension of the panel is also not critical, and so could range from very small to very large. Conceivable, a very large doll house could be played with by a plurality of children at the same time.

An alternative embodiments, the doll house could comprise either the center member or panel alone or could include one or more side panels. If there were only one side panel, it could be hingedly connected to and of the same size as the center panel.

As shown in FIGS. 1 and 2, the major surface of panels 14 and 15 comprise printed exterior surfaces 21 and 22, which together, in the closed position, illustrate the exterior of the house, and interior surfaces 23 and 24 which in the closed position contact and cover center panel 17 in parallel, spaced relationship thereto, and in the open position are exposed and adjacent to the center panel as shown in FIG. 2.

Figure 3:
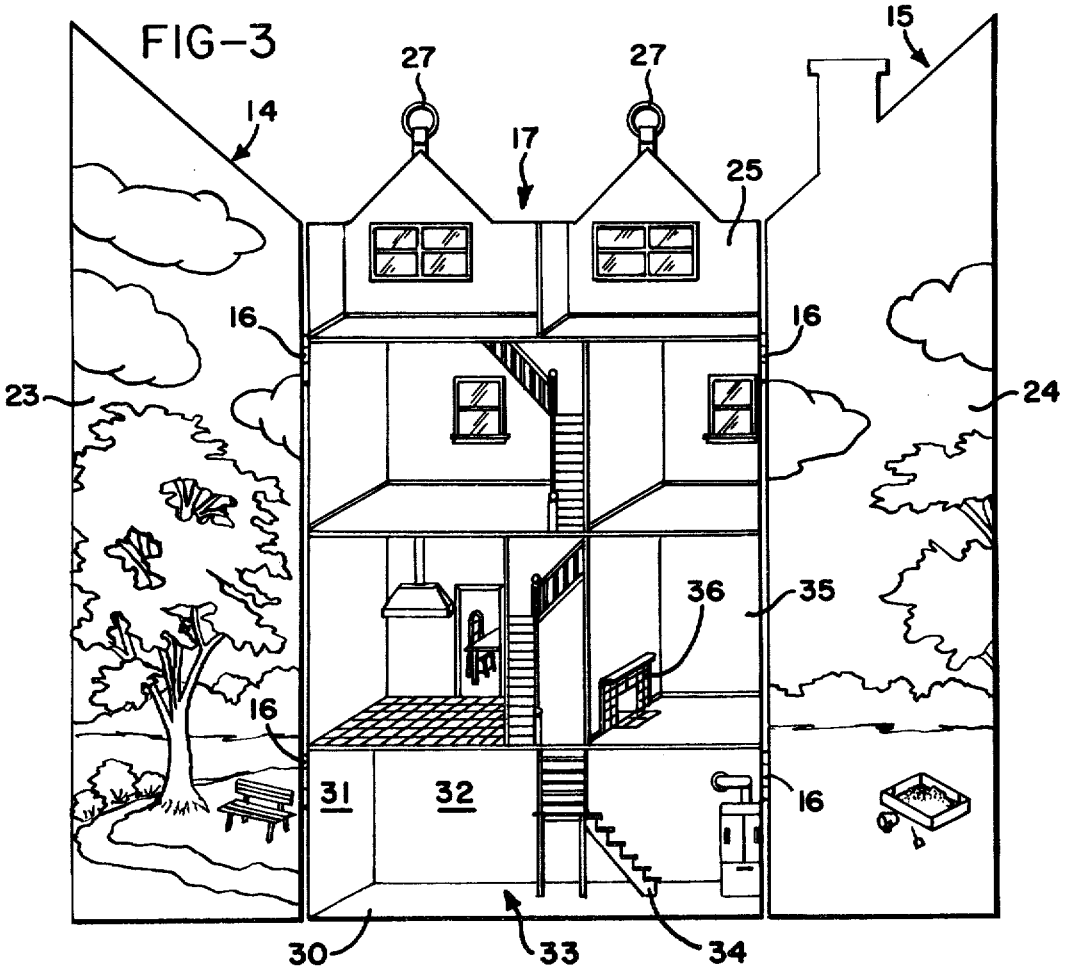
FIG. 3 is a front elevation of the doll house of FIG. 2.
Figure 4:
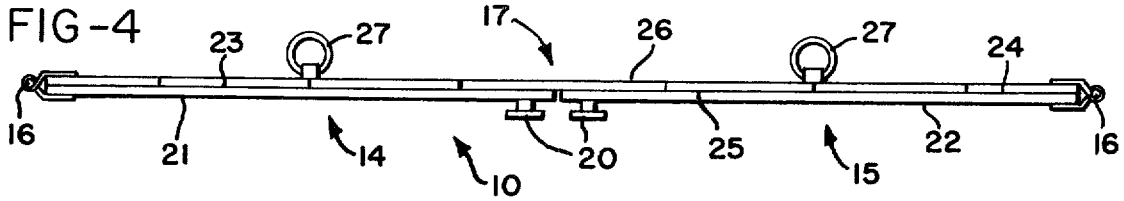
FIG. 4 is a top view of the doll house of FIG. 1.

Center panel 17 comprises surface 25 which is exposed in the open position and surface 26 (shown in FIG. 4) which is in contact with and supported by wall 12. Center panel 17 may be supported or hung on wall 12 by an appropriate means on center panel 17, such as rings 27 or the like over a nail or other supportive means (not shown) driven into wall 12. As shown in FIG. 3, the peripheral edges of center panel 17 describe the outline of the house interior, and expose surface 25 illustrates interior rooms in the house.

Although surface 25 is essentially two-dimensional, the printing is such that one has the impression that the rooms are three-dimensional. For example, basement room 30 has walls 31 and 32 and floor 33 printed so as to create the appearance of a three-dimensional room. Stairs such as stairs 34 are illustrated to enable child playing with doll house 10 to go from room to room. Additionally, the features of a room may be included to suggest to the child how the room is or could be used. For example, in living room 35, a fireplace 36 has been illustrated. If this were a school room, it might be a blackboard, or in a firehouse it might be a firepole, etc. Interior surfaces 23 and 24 of side panel 14 and 15 may be printed to illustrate exterior scenes, the environment and the like, such as a park shown on surface 23 in FIG. 3, or a beach shown on surface 24.

In the closed position, doll house 10 comprises essentially two thicknesses, one thickness is panels 14 and 15 and the other thickness is panel 17. That is, panels 14 and 15 are in parallel, spaced relationship to panel 17. In the open position, panels 14 and 15 are adjacent to and laterally aligned with center panel 17, the result is that the doll house is essentially a single thickness. Thus, the doll house is convenient in that it does not require a large amount of space away from the wall surface.

Figure 5:
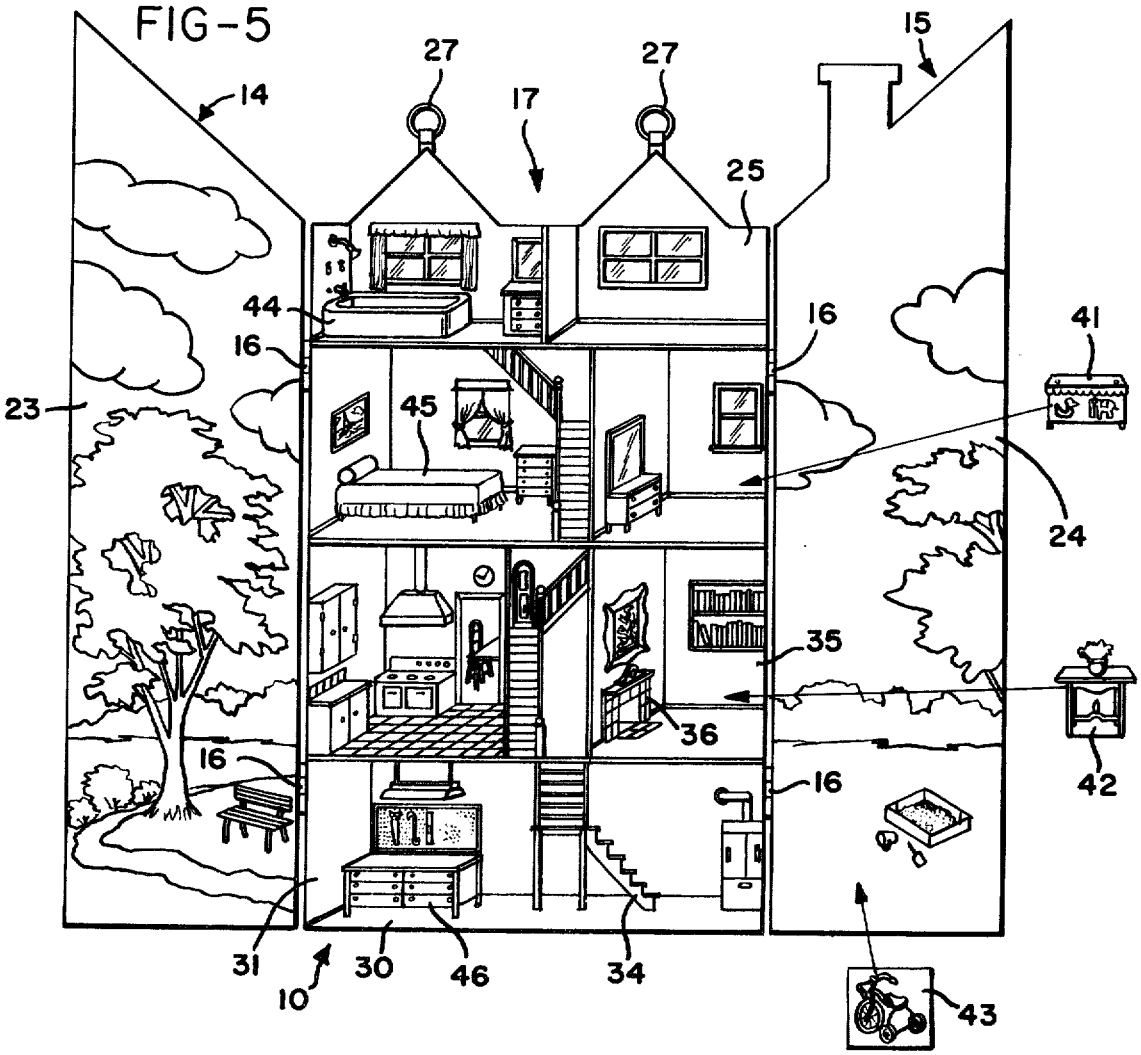

The use of the doll house is shown in FIG. 5. Pieces, such as pieces of furniture or the like, which may be either magnetic themselves or have magnets embedded therein, may be placed and arranged on the surfaces of a doll house 10 during play. Illustrated are a toy box 41, and table 42 and a tricycle 43 which are yet to be placed on the exposed playing surfaces, and bathtub 44, bed 45 and workbench 46 which have already been placed on the surface. Alternatively, the surface could be the magnet and the pieces be of a magnetic material.

Figure 6:
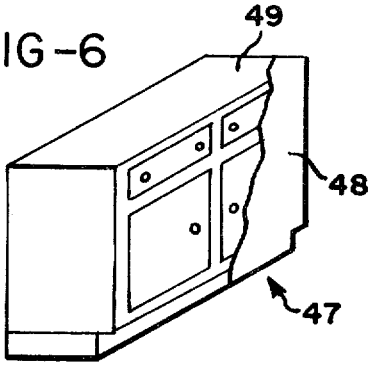
FIGS. 6 and 7 are elevational views, partially broken away, of the pieces for use with a doll house in accordance with the teachings of the invention.
Figure 7:
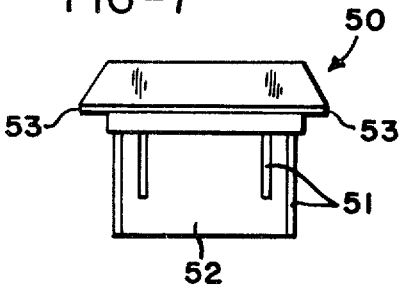

As shown in FIGS. 6 and 7, the pieces are essentially two dimensional, i.e., generally thin, flat, rectangular pieces, but printed so as to illustrate three-dimensional pieces. But, the pieces are not limited to rectangular shapes, and so can be triangular, round and the like. Further, the pieces may have surface embossments to enhance the three-dimensionality. FIG. 6 illustrates a cabinet 47, and comprises a base 48 having its exposed surface printed, as at 49, to three-dimensionally illustrate the cabinet. FIG. 7 illustrates a table 50. Whereas a conventional doll house table would have thin, "realistic" legs which are capable of being broken off, the furniture pieces for use in the doll house of the invention are illustrations having the legs 51 printed against a printed background 52. Thus, although the piece illustrates a three-dimensional table, it does not have exterior parts readily capable of being broken off or lost. For added realism the pieces may be provided with some exterior shape such as will enhance the illustrated three-dimensionality of the pieces, such as by providing corners 53 on table 50 in FIG. 7. But, the pieces should avoid presenting parts easily broken off.

An added feature, which might be employed in the doll house of the invention, is a ledge, flange, or the like, similar to the ledge on a chalkboard, to stop pieces, when they slide down the face of the doll house.

While the form of apparatus herein described constitutes preferred embodiments of this invention, it is to be understood that the invention is not limited to this precise form of apparatus, and that changes may be made therein without departing from the scope of the invention.

What is claimed is:

1. A doll house comprising an essentially planar, magnetically responsive member defining a building interior, said surface being printed to illustrate three-dimensionally a plurality of interior rooms of the building, a plurality of essentially planar, magnetically responsive pieces which are surface-printed so as to illustrate three-dimensionally pieces of furniture, fittings and the like and which are attached magnetically to the surface of said member and arranged at will in the rooms of the doll house to illustrate completed interior rooms, and further including at least one essentially planar side member hingedly connected to a vertical peripheral edge of said member, said side member being capable of rotating about said hinged connections to extend laterally from and along side of said vertical peripheral edge of said member to uncover and expose said member and to extend, in spaced, parallel relationship, in front of said member, said side member having peripheral edges which describe the outline of an exterior of the building and printing thereon which, in said closed relationship, three-dimensionally illustrates the exterior of said building.

2. A doll house as in claim 1 wherein said side member comprises a magnetically responsive material.

3. A doll house comprising an essentially planar, magnetically responsive member defining a building interior, said surface being printed to illustrate three-dimensionally a plurality of interior rooms of the building, a plurality of essentially planar, magnetically responsive pieces which are surface-printed so as to illustrate three-dimensionally pieces of furniture, fittings and the like and which are attached magnetically to the surface of said member and arranged at will in the rooms of the doll house to illustrate completed interior rooms, means for supporting said member in contact with a wall in hanging and supporting relationship, and further including essentially planar side members located on either side of and hingedly connected to the vertical peripheral edges of said member, said side members capable of being rotated about said hinged connections to extend laterally from and along side of the vertical peripheral edges of said member in an open relationship to uncover and expose said member and to extend, in spaced, parallel relationship, in front of said member, said side members having peripheral edges describing the outline of an exterior of the building and having printing thereon which is exposed when said side members are closed and which three-dimensionally illustrates the exterior of said building.

4. A doll house as in claim 3 wherein said side members are comprised of a magnetically responsive material.

5. The doll house of claim 3 wherein the surface of said side panels exposed when said side panels are in said open relationship are printed to three-dimensionally illustrate the exterior environment of the building.

6. A doll house comprising an essentially planar, center magnetically responsive member, having peripheral edges defining an outline of a building interior, and being a printed surface which three-dimensionally illustrates a plurality of interior rooms of the building, a plurality of essentially planar, magnetically responsive pieces which are surface-printed so as to three-dimensionally illustrate pieces of furniture, fittings and the like and which are attached magnetically to said center member and arranged at will in the rooms of the doll house to illustrate completed interior rooms, means for supporting said member whereby said center member may be hung upon and supported in contact with a wall, and at least one essentially planar side member located on a side of and hingedly connected to the peripheral edge of said center member whereby said side member can be swung about said hinged connections to laterally extend said side member from the peripheral edges of said center member uncovering and exposing said center member and to bring said side member in front of and in overlying relationship to said center member, said side member having printing thereon three-dimensionally illustrating the exterior of said building whereby when said side member is hingedly swung so as to uncover said center member the interior and exterior of the building will be shown.

* * * * *